US005610618A

United States Patent [19]

Adrian et al.

[11] Patent Number: 5,610,618

[45] **Date of Patent: *Mar. 11, 1997**

[54] MOTOR VEHICLE ANTENNA SYSTEMS

[75] Inventors: Andrew Adrian, Ypsilanti; Bruce R. Jones, Romulus; Robert A. Schuessler, Canton, all of Mich.

[73] Assignee: Ford Motor Company, Dearborn, Mich.

[ * ] Notice: The term of this patent shall not extend beyond the expiration date of Pat. No. 5,483,247.

[21] Appl. No.: 359,485

[22] Filed: Dec. 20, 1994

[51] Int. Cl.[6] ..... H01Q 1/32

[52] U.S. Cl. ..... 343/713; 343/711; 343/767

[58] Field of Search ..... 343/713, 704, 343/711, 767, 712; H01Q 1/32

[56] References Cited

U.S. PATENT DOCUMENTS

| | | | |
|---|---|---|---|
| 2,751,589 | 6/1952 | Cary | 343/767 |
| 2,923,813 | 2/1955 | Davis | 343/713 |
| 3,680,142 | 7/1972 | Van Atta et al. | 343/770 |
| 3,805,266 | 4/1974 | Fletcher et al. | 343/708 |
| 3,810,180 | 5/1974 | Kunert et al. | 343/713 |
| 3,810,183 | 5/1974 | Krutsinger et al. | 343/708 |
| 3,827,054 | 7/1974 | Herskind | 343/708 |
| 4,063,247 | 12/1977 | Sakurai et al. | 343/704 |
| 4,069,472 | 1/1978 | Kamata et al. | 340/146.3 K |
| 4,072,953 | 2/1978 | Comastri et al. | 343/713 |
| 4,072,954 | 2/1978 | Comastri et al. | 343/713 |
| 4,132,995 | 1/1979 | Monser | 343/767 |
| 4,682,180 | 7/1987 | Gans | 343/769 |
| 4,710,775 | 12/1987 | Coe | 343/727 |
| 4,853,704 | 8/1989 | Diaz et al. | 343/767 |
| 4,958,162 | 9/1990 | Roberts et al. | 343/700 MS |
| 5,083,135 | 1/1992 | Nagy et al. | 343/713 |
| 5,138,330 | 8/1992 | Lindenmeier et al. | 343/713 |
| 5,202,697 | 4/1993 | Bonebright et al. | 343/770 |
| 5,289,197 | 2/1994 | Lindenmeier et al. | 343/713 |
| 5,355,144 | 10/1994 | Walton et al. | 343/767 |
| 5,483,247 | 1/1996 | Adrian et al. | 343/713 |

FOREIGN PATENT DOCUMENTS

| | | | |
|---|---|---|---|
| 2635217 | 9/1978 | Germany | 343/704 |
| 63-292702 | 11/1988 | Japan | H01Q 1/32 |
| 2180695 | 4/1987 | United Kingdom | 343/713 |

OTHER PUBLICATIONS

"Development of Capacitance–Loaded Window Antenna for AM/FM Car Radios", T. Taniguchi, K. Shigeta and K. Kubota, Mazda Motor Corp., SAE Technical Paper Series–950180, The Engineering Society for Advancing Mobility Land Sea Air and Space International, Feb. 27–Mar. 2, 1995, Detroit, Michigan, International Congress and Exposition, pp. 1 through 8.

*Primary Examiner*—Hoanganh T. Le
*Attorney, Agent, or Firm*—Mark L. Mollon; Roger L. May

[57] ABSTRACT

A motor vehicle antenna system is disclosed for receiving electromagnetically radiated signals in the FM radio broadcast frequency range. The antenna system includes a magnetic current receiving, conformal, substantially rectangular truncated slot antenna. The slot antenna is defined in part by a substantially horizontal portion of a conductive periphery of a window opening of the motor vehicle. The slot antenna is further defined in part by a conductive trace integral with a glazing panel mounted in the window opening. The conductive trace extends horizontally a distance equal to one-half a wavelength in the FM broadcast frequency band. The ends of the trace are effectively connected to the conductive periphery of the window opening. An electrical lead is provided for carrying signals from the slot antenna to a radio receiver, having a first conductor connected to the conductive window periphery and a second conductor coupled to the slot antenna, such as by a network feed structure integral with the windshield, optionally forming an electrical junction with the trace. The side points of the trace are effectively connected to the conductive periphery, e.g., by direct physical connection using an electrical lead, or by providing vertically-extending end traces parallel and proximate to opposite vertical portions of the electrically conductive periphery of the window opening.

15 Claims, 5 Drawing Sheets

MOTOR VEHICLE ANTENNA SYSTEMS

FIELD OF THE INVENTION

This invention relates to motor vehicle antenna systems, and more particularly to motor vehicle antenna systems employing certain conformal antennas incorporated into the shape or contour of the motor vehicle body.

BACKGROUND

Automobile FM radio receivers typically employ mast or whip antennas. Conformal antennas also are known, which are advantageously formed, for example, by incorporation into a glazing panel of the motor vehicle. Conformal antennas are disclosed in U.S. Pat. No. 3,810,180 to Kunert et al, of the "T" antenna type. The Kunert et al teaching is directed toward an electric current receiving element formed by electrically conductive wires embedded in a vehicle windshield. The "T" element of Kunert et al is essentially a top loaded monopole in the windshield. Disadvantageously, the "T" element includes vertically extending wires in the vehicle operator's line of sight.

It is an object of the present invention to provide novel conformal antenna motor vehicle antenna systems. In particular, it is an object of the invention to provide such antenna systems which are suitable for use in motor vehicle windshields and other glazing panels of a motor vehicle body.

SUMMARY

In accordance with a first aspect, a motor vehicle antenna system has a magnetic current receiving, conformal, substantially rectangular, truncated slot antenna. The slot antenna has a horizontal length L equal to one-half a wavelength in the FM broadcast frequency band. The vertical dimension of the slot antenna, referred to here as its width, is substantially less than dimension L, preferably being only 3% to 20% of dimension L, more preferably 10% to 15% of dimension L. The slot antenna is defined in part by the sheet metal or other conductive periphery of a window opening in the vehicle body. Specifically, the slot antenna is defined in part by a substantially horizontal portion of a conductive periphery of the window opening, typically being formed by the edge of a sheet metal body panel and/or metal frame components for the window opening. The slot antenna is also formed in part by a conductive trace formed integrally with a glazing panel mounted in the window opening. The conductive trace, which may be formed on or imbedded in the glazing panel, extends laterally from a first side point to an opposite side point substantially parallel the aforesaid horizontal portion of the conductive periphery of the window opening. In addition, suitable means are provided for effectively connecting each of the two side points of the conductive trace to the conductive periphery of the window opening. An electrical lead is provided for carrying signals from the slot antenna to a radio receiver. A first conductor of the electrical lead is connected to the conductive periphery of the window opening, and a second conductor of the electrical lead is coupled to the slot antenna as described further below.

In accordance with certain preferred embodiments, the motor vehicle antenna system disclosed here is used in conjunction with the invention disclosed in a patent application entitled Method And Apparatus For Eliminating Resonance In A Vehicle Antenna System, which is commonly assigned herewith and is filed concurrently herewith.

Window openings defined by a conductive vehicle body have resonances within the FM broadcast band. These resonant openings can create distortions from the desired omnidirectional antenna pattern. In accordance with the aforesaid preferred embodiments, the glazing panel mounted in one or more window openings of a vehicle body, other than in the area forming the slot antenna, is coated or otherwise provided with a transparent, electrically conductive layer which extends over a sufficient portion of the window opening to effectively alter the size of the window opening and reduce or eliminate the undesired resonance. The conformal window antenna may be provided, for example, in a windshield or backlite (i.e., rear window) of a motor vehicle. The other such glazing panel can be provided with the aforesaid electrically conductive layer to reduce or eliminate resonance within the FM band. A more omnidirectional reception pattern is thereby achieved. These and additional features and advantages will be further understood from the discussion below of various preferred embodiments.

BRIEF DESCRIPTION OF THE DRAWINGS

The following discussion of certain preferred embodiments of the invention refers to the appended drawings wherein.

Figure 1:
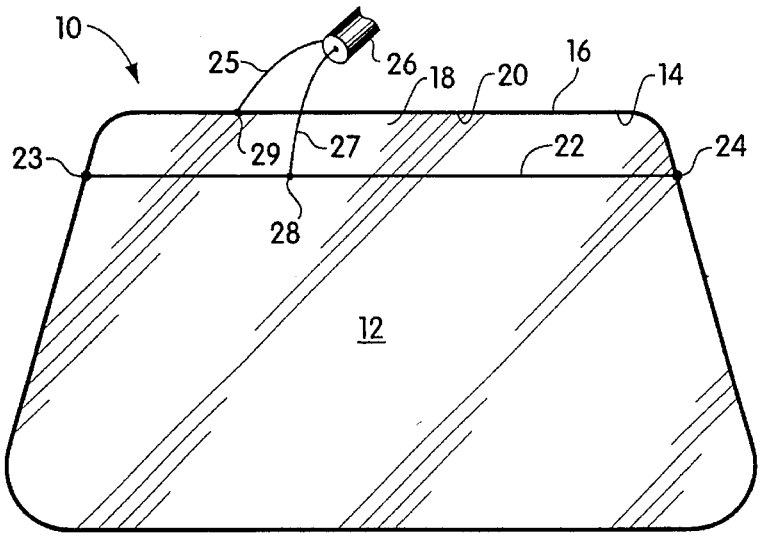
FIG. 1 is a schematic elevation view, partially broken away, of a motor vehicle antenna system provided by a windshield mounted in a motor vehicle windshield opening.

Terms used in the following discussion to describe direction or orientation refer to the illustrated embodiments, unless otherwise clearly indicated. In general, the lateral direction is horizontally right-to-left as viewed from the front or rear of the vehicle. Horizontal vehicle lines, may, in fact, be curvolinear, and at an angle to true horizontal, in accordance with current aerodynamic vehicle designs. Similarly, "vertical", e.g., with reference to a windshield or backlite, may be curvolinear and may be at an angle to true vertical, again in accordance with aerodynamic vehicle designs. The terms inward and inwardly generally mean into or toward the passenger compartment of the vehicle and, correspondingly, the terms exterior, outward and outwardly generally mean to or toward the outside of the passenger compartment.

DETAILED DESCRIPTION OF CERTAIN PREFERRED EMBODIMENTS

The motor vehicle antenna systems of the present invention are most advantageously implemented in a windshield or backlite of a motor vehicle. The FM broadcast band, 88 to 108 MHz, has a one half wavelength of approximately 1.4 to 1.75 meters. Thus, the one half wavelength slot antennas used in the antenna systems disclosed here are readily positioned along a lower or, more preferably, upper horizontal region of the windshield or backlite. In the preferred embodiment schematically illustrated in FIG. 1, the motor vehicle antenna system 10 is provided in a vehicle windshield 12 which is mounted in the vehicle's windshield opening 14, having an electrically conductive periphery 16. A substantially rectangular, truncated slot antenna 18 has a horizontal length equal to one-half a wavelength in the FM broadcast frequency band. Its vertical dimension, referred to here as the width of the slot antenna, is substantially less than the length of the antenna, preferably being 10% to 15% of its length. The slot antenna is conformal in that its componentry conforms to, or substantially lies in, the curvoplaner shape of the vehicle body, since it is substantially in the plane of the windshield. Slot antenna 18 is seen to be defined in part by the upper horizontal portion 20 of the electrically conductive windshield periphery 16. The slot antenna is further defined in part by conductive trace 22 which is integral with the windshield. Conductive trace 22 is seen to extend horizontally, substantially parallel to upper horizontal portion 20 of the windshield perimeter, from a first side point 23 to an opposite side point 24.

The conductive trace can be provided, for example, as an electrically conductive film deposited on an inside surface of the outer or inner glass panes laminated to form a typical motor vehicle windshield. The conductive trace preferably comprises a metal film, which in certain preferred embodiments may be substantially transparent to visible light. The metallized film may be covered by or sandwiched between protective films of metal oxide or the like. Such films and film stacks may be formed in accordance with techniques well known for producing electrically heated glazing panels.

The two side points are effectively connected to the electrically conductive periphery 16 of the windshield opening. It should be understood that the periphery of the windshield may include a metal frame element, conductive adhesive material used to mount the windshield in the windshield opening, or even an equivalent conductive member, such as a conductive strip extending circumferentially in or on the windshield proximate its peripheral edge. In the embodiment of FIG. 1, side points 23 and 24 of trace 22 form an electrical junction with the vehicle body sheet metal or a metal frame member using wire interconnects and ground lugs in accordance with known techniques. Thus, the sheet metal edge 20 cooperates with the conductive trace 22 interconnected by ground lugs at points 23 and 24 to form a substantially rectangular slot antenna approximately one-half wavelength long at the FM broadcast band. Such slot antenna simulates with good performance characteristics a traditional slot antenna, which, in the ideal sense, is a rectangular opening in an electrically large conducting planar surface, being electrically short in height and approximately one-half wavelength wide. By using sheet metal or the like of the automobile body as the conductive surface around the slot antenna disclosed here, a conformal slot antenna is achieved with advantageously few components and correspondingly low manufacturing and assembly costs.

An electrical lead is provided in the antenna system of FIG. 1 for carrying signals from the slot antenna to a radio receiver in the vehicle. The electrical lead is seen to comprise a first conductor 25 provided preferably as the outer sheath of coaxial cable 26. First conductor 25 is connected to the electrically conductive periphery 16 of the windshield opening, preferably to the upper horizontal portion 20 at electrical junction 29. A second conductor 27 of the electrical lead is coupled to the slot antenna. In the embodiment of FIG. 1, lead 27 comprises the center wire of cable 26 which extends coaxially within sheath 25. The second conductor 27 forms an electrical junction with 28 with conductive trace 22. The location of junction 28 along trace 22 is selected to provide the desired antenna impedance. The closer the feed point 28 is to the side point 23 or 24, that is, the closer the feed point is to an end of the slot, the lower the antenna input impedance is. Conversely, the closer the feed point is to the center of the slot antenna, the higher the impedance is. Without wishing to be bound by theory, it presently is understood that since the ground plane around the slot antenna is not infinite in extent and very truncated, the vertically polarized (co-polarized) E-field radiation patterns in the H-plane become more omnidirectional. Thus, by adjusting the feed point location along the length of the slot (the horizontal dimension of the slot antenna) the impedance that the antenna presents to the feed transmission line can be controlled.

Figure 2:
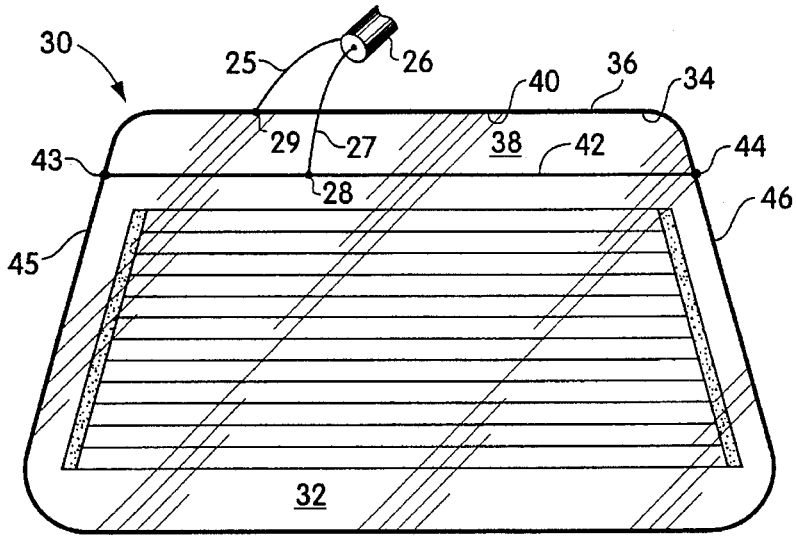
FIG. 2 is a schematic elevation view, partially broken away of a motor vehicle antenna system provided by a backlite mounted in a motor vehicle backlite opening.

A motor vehicle slot antenna substantially like that of FIG. 1 can be implemented in a motor vehicle backlite, as illustrated in FIG. 2. Specifically, an antenna system 30 is seen to comprise a backlite 32 mounted in the vehicle's backlite opening 34 defined by electrically conductive periphery 36 formed by vehicle body sheet metal and/or by a backlite frame or the like. Slot antenna 38 is formed in part by upper horizontal portion 40 of conductive periphery 36 and in part by conductive trace 42 which is integral with the backlite, optionally being formed in or on a surface of the backlite glass. The first end 43 and second end 44 of the conductive trace 42 are connected directly to opposite vertical portions 45 and 46, respectively, of the conductive periphery 36 using hard wired connections, ground lugs and or screws or the like, as discussed in connection with the embodiment of FIG. 1. Using such hard wired connections for grounding can involve undesirable manufacturing expense. Accordingly, eliminating the need for hard wired connections between the glass and the conductive periphery of the window opening in accordance with certain preferred embodiments now discussed, can provide significant cost reduction.

Since the electromagnetic field distribution in a one-half wavelength rectangular slot antenna is similar to that in a one-half wavelength transmission line, the need for a direct connection between the conductive trace and the conductive window opening periphery is avoided using what presently is understood to be analogous to transmission line techniques. That is, without wishing to be bound by theory, the E-field at the ends of the slot antenna is at a local minimum. Maintaining this condition at the ends of the slot antenna, without the direct connections at points 23 and 24 in FIG. 1, or points 43 and 44 in FIG. 2, is found to produce similar results in the radiation patterns and input impedance. Accordingly, in the embodiment of FIG. 3, means are provided for effectively connecting the first side point and the opposite side point of conductive trace to the conductive periphery of the windshield opening other than by hard wired connection.

Figure 3:
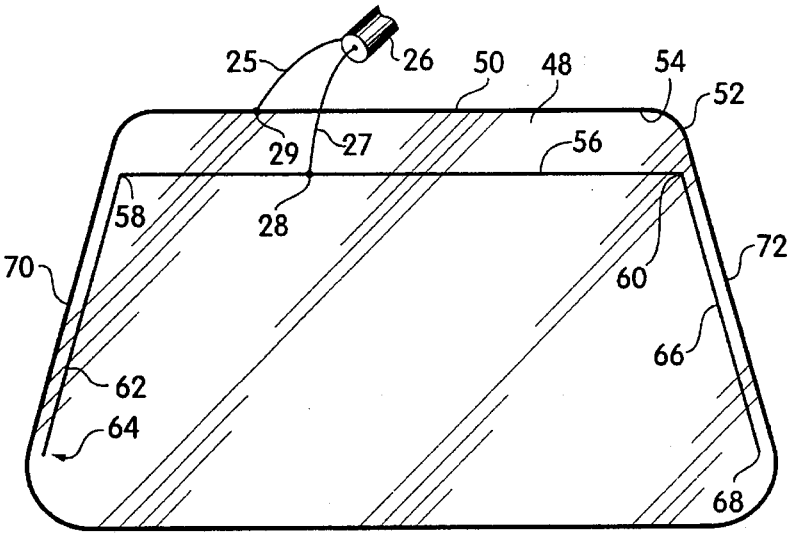
FIGS. 3–10 are schematic elevation views, partially broken away, of vehicle antenna systems in accordance with alternative preferred embodiments.

More specifically, in the embodiment of FIG. 3, a slot antenna 48 is formed in part by the upper horizontal portion 50 of an electrically conductive periphery 52 of a motor vehicle windshield opening 54. Metallized trace 56 extends horizontally, substantially parallel upper portion 50 of the windshield periphery, between a first side point 58 and an opposite side point 60. The means for effectively connecting the two side points to the conductive periphery 52 comprises a substantially vertically extending end trace 62 between first side point 58 and bottom point 64. A second end trace 66 extends from side point 60 to second bottom point 68. The two end traces preferably are formed as unitary extensions of the main metallized trace 56 in a single manufacturing step using the materials and techniques mentioned above. End trace 62 is seen to extend vertically parallel to a first vertical side portion 70 of the conductive periphery 52. It will be understood by those who are skilled in the art in view of the present disclosure, that trace 62 should be proximate to conductive periphery portion 70 in the sense that it is sufficiently close for effectively connecting them in accordance with transmission line techniques mentioned above. Similarly, trace 66 is parallel and proximate to opposite vertical portion 72 of the electrically conductive periphery 52 of the windshield opening. Thus, without intending to be bound by theory, trace 62 and 66 are seen to form a one-quarter wavelength long transmission line with the vertical portions 70 and 72, respectively, of the conductive periphery 52. Since the bottom points 64 and 68 are left open-circuited in the preferred embodiment illustrated in FIG. 3, a local E-field minimum is impressed upon the slot antenna at its side points 58 and 60, substantially simulating the boundary conditions achieved via hard wired connections, as in the embodiments of FIGS. 1 and 2. Consequently, the radiation patterns and input impedance are effectively the same as those achieved with hard wired connections.

Figure 4:
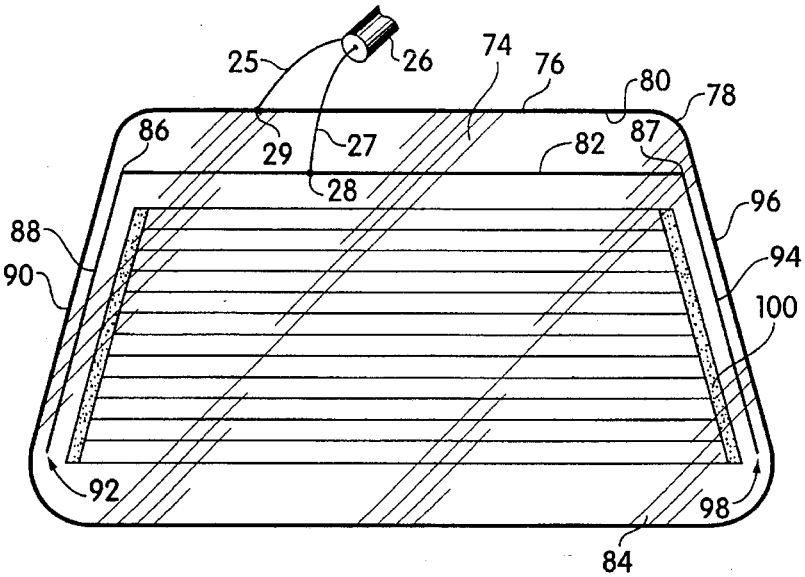

Motor vehicle antenna systems in accordance with the embodiment of FIG. 3 comprising end traces from the right and left side points of the conductive trace defining in part the slot antenna, can be implemented in a backlite of a motor vehicle, not withstanding that the backlite incorporates an electrical resistance heater grid. Thus, in the preferred embodiment schematically illustrated in FIG. 4, a slot antenna 74 is defined in part by the upper horizontal portion 76 of an electrically conductive periphery 78 surrounding motor vehicle backlite opening 80. Slot antenna 74 is further defined in part by metallized trace 82 extending horizontally within or on a surface of backlite 84 mounted within the backlite window opening 80. Means for effectively connecting the first side point 86 of metallized trace 82 to the conductive periphery 78 comprises vertical end trace 88 extending one-quarter of a wavelength in the FM broadcast band, so as to have for example one-half the longitudinal dimension of trace 82. End trace 88 is seen to extend parallel and proximate vertical portion 90 of the conductive periphery 78 between side point 86 and bottom point 92. Similarly, the opposite end trace 94 extends proximate and parallel vertical portion 96 of the conductive periphery, between side point 87 and bottom point 98. Advantageously, the effective functioning of slot antenna 74 is achieved notwithstanding the electrical resistance heater grid 100 incorporated into backlite 84. Significantly, this remains true even during operation of the heater grid.

Figure 5:
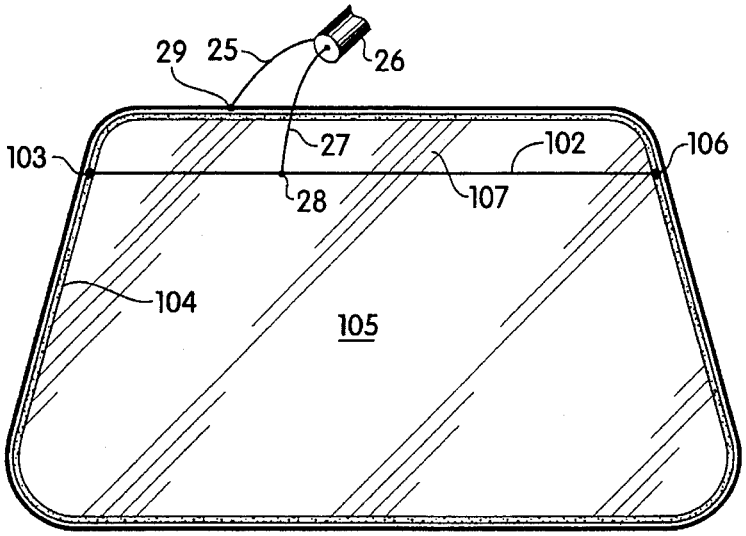

Another preferred embodiment of the motor vehicle antenna system disclosed here, having means for effectively connecting the side points of the metallized trace to the conductive periphery of the window opening without hard wired connections to periphery sheet metal or the like, is illustrated in FIG. 5. Metal trace 102 has a first side point 103 which contacts an adhesive material 104 which extends circumferentially about the outer perimeter of the glazing panel 105. Preferably, adhesive 104 is the material used to mount glazing panel 105 into the motor vehicle window opening. Adhesive 104 is conductive, i.e., it is conductive in the antenna operating frequency band. Opposite side point 106 of trace 102 is similarly in contact with the circumferentially extending strip of adhesive material 104. Suitable conductive adhesive materials include numerous commercially available polyurethane adhesives loaded with carbon black. Such loaded adhesives are used frequently for mounting motor vehicle glazing panels to achieve color requirements. Sufficient carbon black loading creates local E-field minimums at side points 103 and 106, such that the slot antenna 107 achieves the desired performance characteristics.

Figure 6:
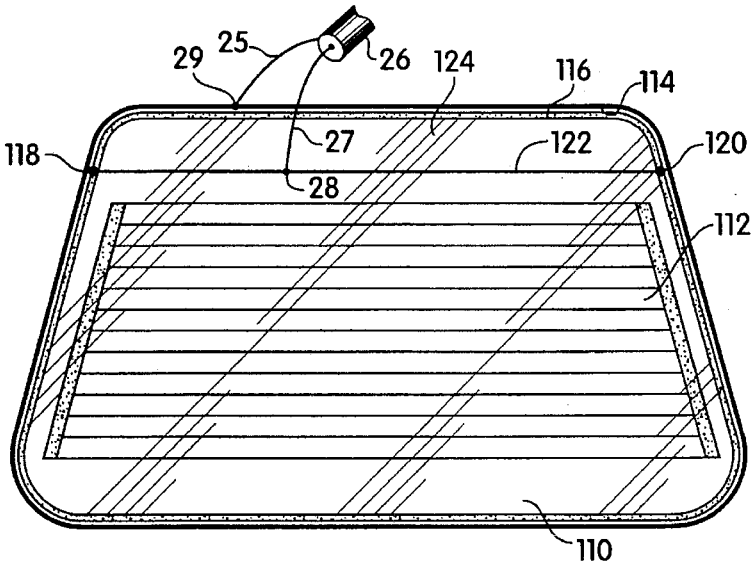

The approach illustrated in the embodiment of FIG. 5 for effectively connecting the side points of the metallized trace to the electrically conductive periphery of the window opening, can be implemented in a vehicle backlite with or without an electrical resistance heater grid incorporated therein. Thus, in the embodiment of FIG. 6, backlite 110 incorporating heater grid 112 is mounted in backlite opening 114 via conductive adhesive material 116 extending circumferentially around the perimeter of backlite 110. Side points 118 and 120 of metallized trace 122 contact conductive adhesive 116 to effectively connect such side points to the conductive periphery of the window opening. Here, again, the slot antenna 124 formed in the embodiment of FIG. 6 is found to have effective functioning characteristics notwithstanding the presence or operation of heater grid 112.

Figure 7:
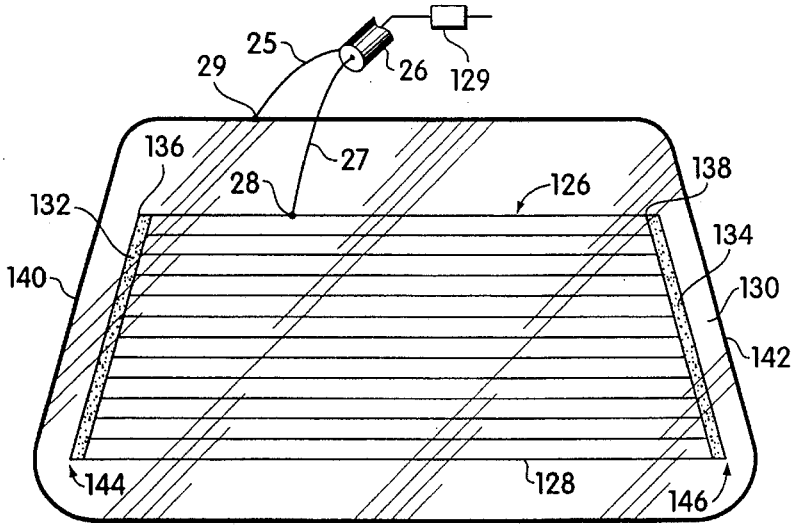

In accordance with certain preferred embodiments, a resistance line of a glazing panel heater grid is used to form in part the boundary of the slot antenna. In such embodiments, the dimensions and location of the heater grid in the glazing panel cooperate with the adjacent conductive periphery of the window opening and other elements now described, to form a slot antenna. In FIG. 7 conductor 25 of coaxial cable 26 is connected to the conductive periphery at junction 29 as described above. Conductor 27 is connected at junction 28 to the uppermost resistive line 126 of heater grid 128, incorporated into glazing panel 130. In view of the electrical connection of conductor 27 to a resistance line of heater grid 128, a series capacitor 129 is employed in the antenna system to prevent direct current for the heating function of the heater grid from flowing down conductor 27. Conductive bus bars 132 and 134 act as end means for effectively connecting the first side point 136 and the second side point 138 to vertical portions 140 and 142, respectively, of the conductive window periphery. As in previously discussed embodiments, the longitudinal dimension between side point 136 and bottom point 144 preferably is one-quarter wavelength in the FM broadcast band. Similarly, the longitudinal dimension between opposite side point 138 and bottom point 146 is also one-quarter wavelength.

Figure 8:
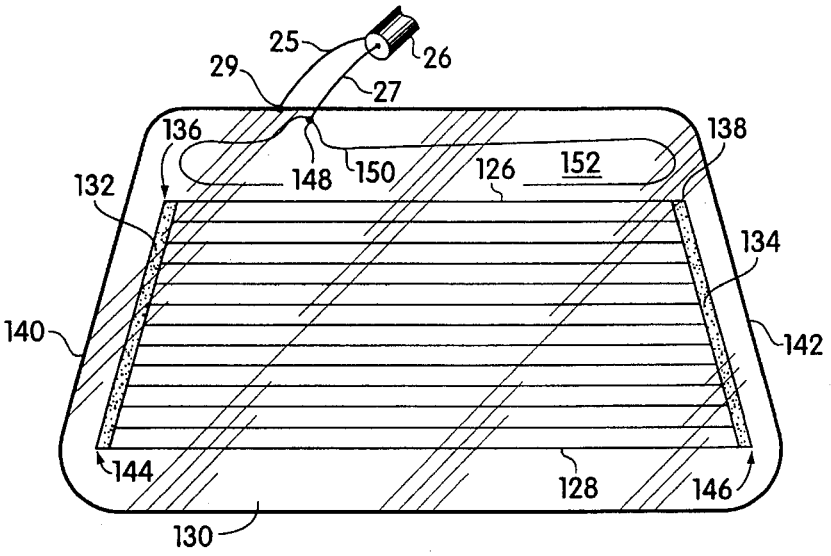

The conductor of the electrical lead means provided for carrying signals from the slot antenna to the radio receiver need not be connected by hard wire junction to the metallized trace defining the slot antenna. In accordance with the motor vehicle antenna systems disclosed here, it can be coupled to the slot antenna also, for example, by a suitable feed network in the slot area. Thus, in the embodiment of FIG. 8, which is otherwise like that of FIG. 7, conductor 27 from coaxial cable 26 has a junction 148 with a feed network 150 disposed within the area of slot antenna 152.

Figure 9:
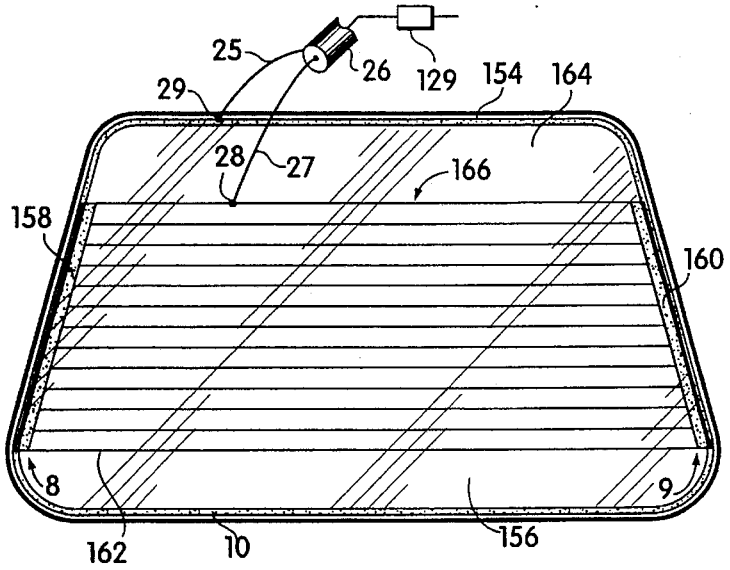
Figure 10:
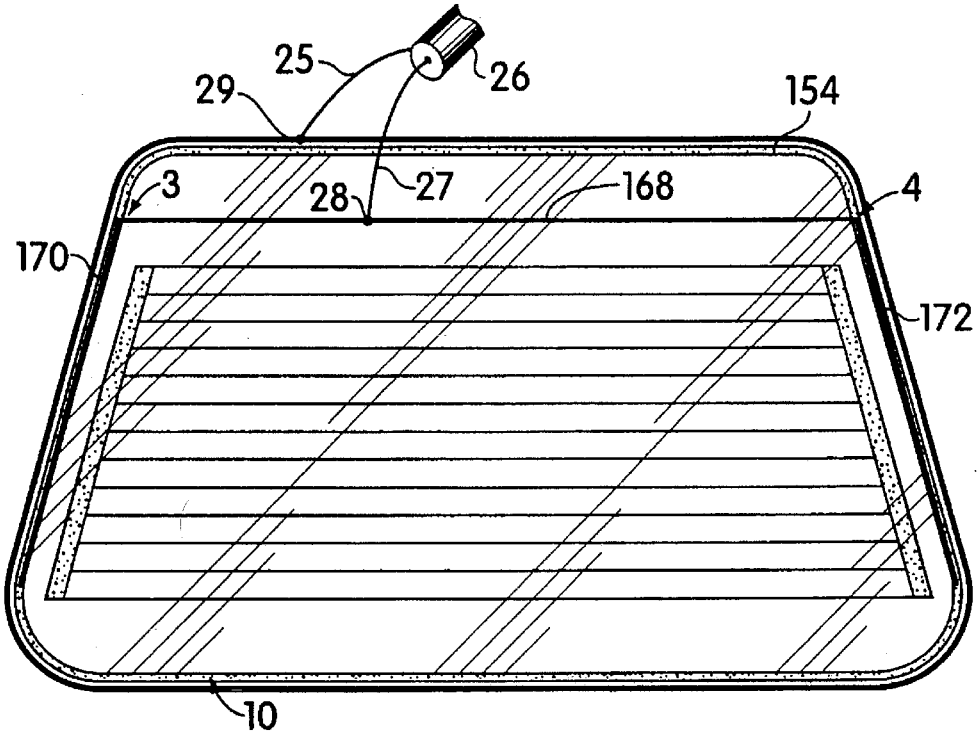

In instances in which a heater grid dimensions and/or location in a glazing panel result in natural residence of the slot antenna being in an imperfect or undesirable frequency band, the slot antenna dimensions can be controlled so as to enable a motor vehicle antenna system in accordance with the present disclosure. Thus, in the embodiment of FIG. 9, a conductive strip 154, e.g., a bead of adhesive material or a metallized trace, is positioned circumferentially about the perimeter of the glazing panel in contact with the vertically-extending bus bars 158 and 160 of heater grid 162. The slot antenna 164 is thus formed in the area of the glazing panel between the uppermost resistance line 166 of the heater grid and the conductive periphery of the window opening as modified by the conductive strip 154. A conductive strip 154 as used in the embodiment of FIG. 9 to modify the conductive periphery of a window opening is employed also in the embodiment of FIG. 10 for like purpose. A metallized trace 168 is provided with vertically-extending end traces 170, 172 in accordance with the principles discussed above. The end traces 170, 172 are seen to be in contact with conductive material 154 along their entire longitudinal dimension. The resonant frequency of the slot antenna is controlled by adjusting the vertical location at which the trace structure, i.e., main horizontal trace 168 and vertical end traces 170, 172, intersects the circumferential strip of conductive material 154. The operating frequency band of the slot antenna will become lower as the trace structure intersection points are positioned lower in the glazing unit, thereby increasing the overall effective length (that is, the horizontal dimension)of the slot antenna.

Figure 11:
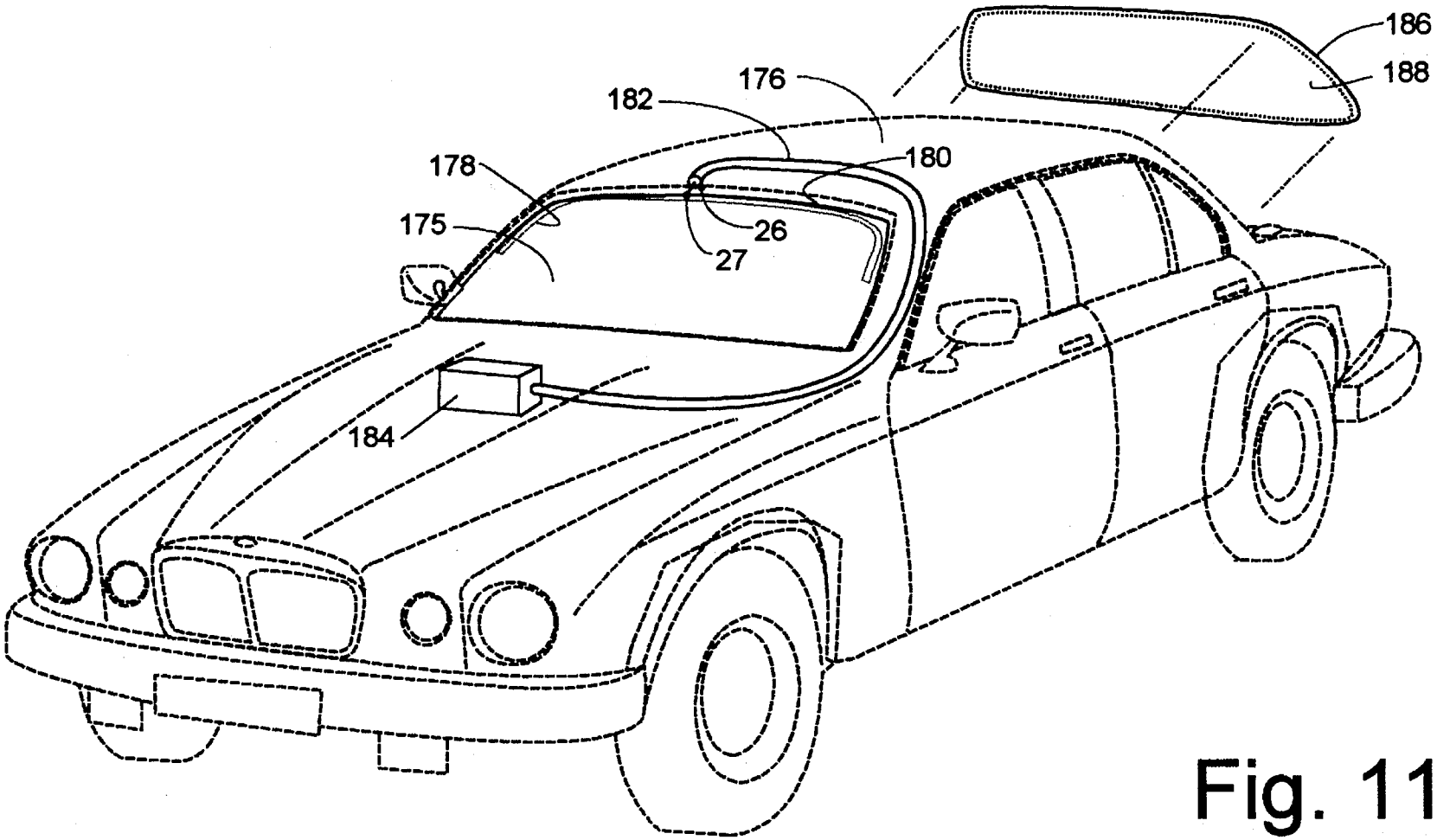
FIG. 11 is a partially exploded, schematic, perspective view of a motor vehicle having an antenna system in accordance with an alternative preferred embodiment of the invention.

In the embodiment schematically illustrated in FIG. 11, a motor vehicle antenna system as described above is provided in a windshield 175 of vehicle 176. Specifically, a metallized trace structure 178 in the upper portion of the windshield forms a slot antenna 180 from which signals are carried by electrical lead means 182 to a radio receiver 184. Backlite 186 would be normally resident at one or more frequencies within the operating frequency band of the slot antenna 180 and, though spaced from the slot antenna, is electromagnetically coupled to it. In accordance with a particularly preferred embodiment, however, a layer of substantially transparent material 188 is provided over a substantial portion of the surface of backlite 186. The material of film 188 is sufficiently conductive to alter the electromagnetic characteristics of the backlite window opening to substantially reduce the extent to which it would parasitically alter the effective directional pattern of the slot antenna 180. Preferably, film 188 is substantially transparent to visible light. It may comprise a metallized film deposited by sputter coating, vapor deposition, etc. Suitable films and film deposition techniques are known. Preferred conductive films are 500–10,000 angstroms thick and are formed of silver, zinc oxide, flourine-doped zinc oxide, cobalt oxide, iron oxide, indium-tin-oxide, chrome oxide, flourine-doped tin oxide and/or like materials, yielding less than 10 ohms per square resistance, preferably 1–2 ohms per square. Both float deposition processes and finished product deposition processes are suitable, such as sputter coating, chemical vapor deposition, pyrolytic processes and like techniques. Alternative suitable materials and deposition techniques will be apparent, whether presently commercially available or developed hereafter, in view of the disclosure provided here. In accordance with one alternative embodiment, film 188 comprises an electrically conductive film adapted for electrical resistance heating of a glazing panel, together with an electrically isolated additional film cooperating therewith to substantially reduce the extent to which the window opening parasitically alters the effective directional pattern of the slot antenna.

Those skilled in the art will recognize that motor vehicle slot antennas as disclosed here can be located in the lower portion of a glazing panel, within the limits of the desired operating frequency ranges. Other modifications, additions and the like will also be apparent to those skilled in the art in view of this disclosure. The appended claims are intended to cover such alternative embodiments of the motor vehicle antenna system.

We claim:

1. A motor vehicle antenna system for receiving electromagnetically radiated signals in the FM radio broadcast frequency band, comprising:

a conformal, substantially rectangular, truncated slot antenna having a horizontal length L equal to one-half a wavelength in the FM broadcast frequency band, and a vertical width dimension substantially less than L, defined in part by a substantially horizontal portion of a conductive periphery of a window opening of the motor vehicle, and in part by a conductive trace integral with a glazing panel mounted in the window opening, the conductive trace extending said length L from a first side point to an opposite side point substantially parallel the horizontal portion of the conductive periphery, and comprising end means for effectively connecting the first side point and the opposite side point to the conductive periphery; and electrical lead means for carrying signals from the slot antenna to a radio receiver, having a first conductor connected to the conductive periphery and a second conductor coupled to the slot antenna.

2. The motor vehicle antenna system in accordance with claim 1 wherein the second conductor is coupled to the slot antenna at an electrical junction along the conductive trace between the first side point and the second side point.

3. The motor vehicle antenna system in accordance with claim 1 wherein the second conductor is coupled to the slot antenna by a conductive feed network integral with the glazing panel, disposed between the conductive trace and the horizontal portion of the conductive periphery.

4. The motor vehicle antenna system in accordance with claim 1 wherein the electrical lead means comprises coaxial cable having an electrically conductive sheath and an electrically conductive core disposed coaxially within the sheath, wherein the sheath is the first conductor and is connected to the conductive periphery at an electrical junction along the horizontal portion, and the core is the second conductor.

5. The motor vehicle antenna system in accordance with claim 1 wherein the end means comprises a first electrical junction of the first side point with a first vertical portion of the conductive periphery and a second electrical junction of the second side point with an opposite vertical portion of the conductive periphery.

6. The motor vehicle antenna system in accordance with claim 1 wherein the end means comprises a conductive first end trace extending from the first side point substantially parallel and proximate to a first vertical portion of the conductive periphery, and a conductive second end trace extending from the opposite side point, substantially parallel and proximate to an opposite vertical portion of the conductive periphery.

7. The motor vehicle antenna system in accordance with claim 6 wherein the first end trace and the second end trace each extends a length equal to one-quarter a wavelength in the FM broadcast frequency band.

8. The motor vehicle antenna system in accordance with claim 1 wherein the glazing panel is a windshield of the motor vehicle.

9. The motor vehicle antenna system in accordance with claim 1 wherein the glazing panel is a backlite of the motor vehicle.

10. The motor vehicle antenna system in accordance with claim 9 wherein the conductive trace is an uppermost horizontal portion of an electrical resistance heater grid, the electrical lead means further comprising series capacitor means for controlling transmission of electrical current from the heater grid along the electrical lead means.

11. The motor vehicle antenna system in accordance with claim 1 further comprising:

a second glazing panel mounted in a second window opening of the motor vehicle, said second window opening being dimensioned to be normally resonant at one or more frequencies within said FM radio broadcast frequency band, and said second glazing panel being spaced from and electro-magnetically coupled to said slot antenna; and a layer of transparent conductive material applied over a substantial portion of the surface of said window panel, said material being sufficiently conductive to alter the electromagnetic characteristics of said first window opening to substantially reduce the extent to which said second window opening parasitically alters the effective directional pattern of the slot antenna.

12. The motor vehicle antenna system in accordance with claim 11 wherein the window opening and the second window opening are the motor vehicle's windshield and backlite openings, respectively.

13. A motor vehicle antenna system for receiving electromagnetically radiated signals in the FM radio broadcast frequency band, comprising:

a conformal, substantially rectangular, truncated slot antenna having a horizontal length L equal to one-half a wavelength in the FM broadcast frequency band, and a vertical width dimension substantially less than L, defined in part by a substantially horizontal portion of a conductive periphery of a window opening of the motor vehicle, and in part by a conductive trace integral with a glazing panel mounted in the window opening, the conductive trace extending said length L from a first side point to an opposite side point substantially parallel the horizontal portion of the conductive periphery, and comprising end means for effectively connecting the first side point and the opposite side point to the conductive periphery, wherein the end means comprises a first junction of the first side point with a conductive adhesive material disposed along a peripheral edge of the glazing panel, and a second junction of the opposite side point with the conductive adhesive material; and electrical lead means for carrying signals from the slot antenna to a radio receiver, having a first conductor connected to the conductive periphery and a second conductor coupled to the slot antenna.

14. A motor vehicle antenna system for receiving electromagnetically radiated signals in the FM radio broadcast frequency band, comprising:

a conformal, substantially rectangular, truncated slot antenna having a horizontal length L equal to one-half a wavelength in the FM broadcast frequency band, and a vertical width dimension substantially less than L, defined in part by a substantially horizontal portion of a conductive periphery of a window opening of the motor vehicle, and in part by a conductive trace integral with a glazing panel mounted in the window opening, the conductive trace extending said length L from a first side point to an opposite side point substantially parallel the horizontal portion of the conductive periphery, and comprising end means for effectively connecting the first side point and the opposite side point to the conductive periphery, wherein the end means comprises a conductive first end trace extending from the first side point substantially parallel and proximate to a first vertical portion of the conductive periphery, and a conductive second end trace extending from the opposite side point, substantially parallel and proximate to an opposite vertical portion of the conductive periphery, and wherein the first end trace and the second end trace each is in contact along its entire length with a conductive adhesive material extending circumferentially around the glazing panel; and electrical lead means for carrying signals from the slot antenna to a radio receiver, having a first conductor connected to the conductive periphery and a second conductor coupled to the slot antenna.

15. A motor vehicle antenna system for receiving electromagnetically radiated signals in the FM radio broadcast frequency band, comprising:

a conformal, substantially rectangular, truncated slot antenna having a horizontal length L equal to one-half a wavelength in the FM broadcast frequency band, and a vertical width dimension substantially less than L, defined in part by a substantially horizontal upper portion of a conductive periphery of a windshield opening of the motor vehicle, and in part by a conductive trace integral with a windshield mounted in the windshield opening, the conductive trace extending from a first side point to an opposite side point substantially parallel the horizontal upper portion of the conductive periphery, and comprising end means for effectively connecting the first side point and the opposite side point to the conductive periphery, the end means comprising a first conductive end trace extending from the first side point substantially parallel and proximate to a first vertical portion of the conductive periphery, and a second conductive end trace extending from the opposite side point substantially parallel and proximate to an opposite vertical portion of the conductive periphery; and electrical lead means for carrying signals from the slot antenna to a radio receiver, comprising coaxial cable having an electrically conductive sheath connected to the conductive periphery at a junction along the horizontal portion, and an electrically conductive core disposed coaxially within the sheath and coupled to the slot antenna at a junction along the conductive trace between the first side point and second side point.

* * * * *